US006773483B2

(12) United States Patent
Flacher

(10) Patent No.: US 6,773,483 B2
(45) Date of Patent: Aug. 10, 2004

(54) SODIUM PURIFICATION METHOD

(75) Inventor: Pierre Flacher, Aigueblanche (FR)

(73) Assignee: MSSA, Saint Marcel (FR)

( * ) Notice: Subject to any disclaimer, the term of this patent is extended or adjusted under 35 U.S.C. 154(b) by 33 days.

(21) Appl. No.: 10/146,067

(22) Filed: May 16, 2002

(65) Prior Publication Data

US 2002/0170390 A1 Nov. 21, 2002

(30) Foreign Application Priority Data

May 16, 2001 (FR) ..... 01 06458

(51) Int. Cl.[7] ..... C22B 26/10
(52) U.S. Cl. ..... 75/408; 75/589; 75/592
(58) Field of Search ..... 75/408, 589, 592

(56) References Cited

U.S. PATENT DOCUMENTS 2,054,316 A * 9/1936 Gilbert ..... 75/408
2,863,757 A 12/1958 Altimier et al.

FOREIGN PATENT DOCUMENTS

FR 1214176 4/1960
FR 2251627 6/1975

OTHER PUBLICATIONS

French Search Report, No. 603777, Feb. 2, 2002, pp. 1–2.

* cited by examiner

*Primary Examiner*—Melvyn Andrews
(74) *Attorney, Agent, or Firm*—Connolly Bove Lodge & Hutz LLP

(57) ABSTRACT

The invention relates to a technical sodium purification method consisting of placing liquid sodium in contact at a temperature greater than or equal to 150° C., inside a static mixer, with an inert gas stream with respect to the sodium containing the stoechiometric quantity of water vapour required to oxidise calcium so as to lower its content to the desired content, and then separating the purified sodium from the inert gas, and the hydrogen and lime produced by the reaction.

5 Claims, 1 Drawing Sheet

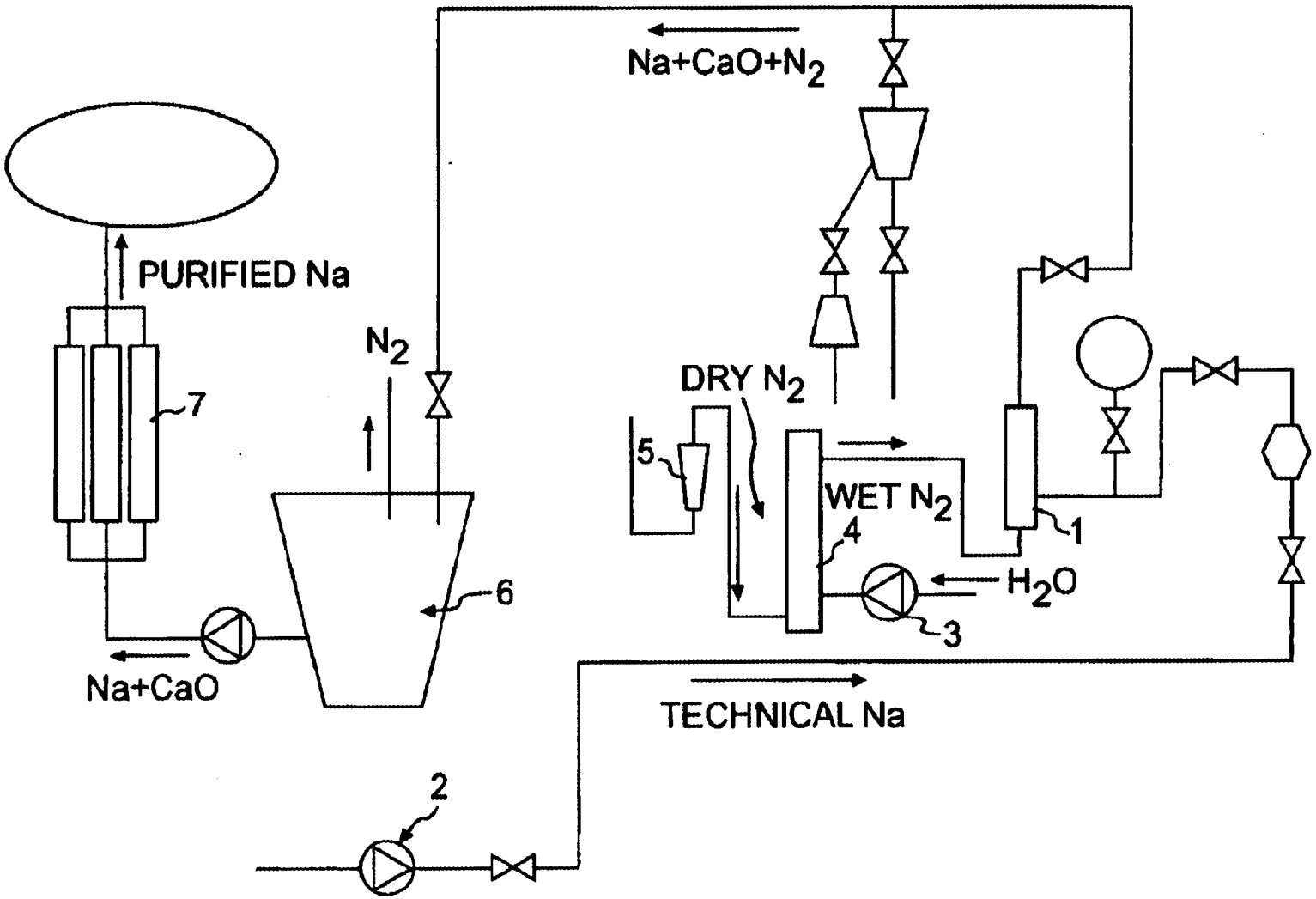
Na+CaO+N2
DRY N2
WET N2
H2O
TECHNICAL Na
N2
PURIFIED Na
Na+CaO
1
2
3
4
5
6
7

SODIUM PURIFICATION METHOD

FIELD OF THE INVENTION

The invention relates to an industrial grade sodium purification method to reduce it calcium content considerably.

STATE OF THE RELATED ART

Sodium produced industrially by molten sodium chloride electrolysis generally has a calcium content of 400 to 500 ppm. This content is greater than the solubility limit of calcium in molten sodium at standard operating temperatures in industry, such that there is a risk of a deposit of calcium in the installations carrying the liquid sodium. In addition, for some applications, such as in the nuclear field for example, this purity is insufficient and, for this reason, different purification methods have been proposed and implemented for several decades.

The patent FR1484647, registered in 1965 by Commissariat à l'Energie Atomique, disclosed the use of sodium peroxide to eliminate calcium. The method consists of mixing sodium and peroxide in a reactor at a temperature between 200 and 300° C. with vigorous stirring, and eliminating the solid lime particles by filtration. In this way, it is possible to obtain sodium containing less than 10 ppm of calcium.

The applicant's patent FR 2251627, registered in 1973, perfected the above method to remedy certain drawbacks such as the discontinuous nature of the method, the solid deposits on the walls of the reactor and the very high peroxide consumption.

However, such a method is not economically adapted to the purification of sodium for more standard applications, for which a varying reduction of the calcium content is desired, without being bound by the strict standards of the nuclear industry.

The patent FR 1214176 held by du Pont de Nemours, published in 1960, discloses a sodium purification method consisting of mixing molten sodium at a temperature below 300° C. with an inert gas, particularly nitrogen, containing 0.1 to 2%, and preferentially 0.1 to 0.5% oxygen, the gas being recycled after passage. The patent specifies that the addition of water vapour into the inert gas instead of oxygen is ineffective, since it does not help render the calcium insoluble to separate it by filtration, decantation or centrifugation.

SUBJECT OF THE INVENTION

The aim of the invention is to offer a sodium purification method by means of calcium oxidation that is simpler and less costly than and at least as effective as the methods of the prior art.

The invention relates to a technical sodium purification method consisting of placing liquid sodium in contact at a temperature greater than or equal to 150° C., inside a static mixer, with an inert gas stream with respect to the sodium containing the stoechiometric quantity of water vapour required to oxidise calcium so as to lower its content to the desired content, and then separating the purified sodium from the inert gas, and the hydrogen and lime produced by the reaction.

DESCRIPTION OF THE INVENTION

The invention is based on the observation made by the applicant that, under certain implementation conditions, and contrary to the disclosure in the patent FR 1214176, the use of water vapour as an oxidant of calcium could result in simple and effective sodium purification.

The method is based on the oxidation reaction: $Ca+H_2O \rightarrow CaO+H_2$. In fact, the reaction probably takes place in two stages via sodium oxide, i.e.: $Na+H_2O \rightarrow NaO+H_2$ and $NaO+Ca \rightarrow Na+CaO$. The quantity of water required for a given quantity of sodium is the stoechiometric quantity corresponding to the calcium to be eliminated, i.e. the difference between the initial calcium content and the target content. Since the method is continuous, this implies that the ratio K between the water flow rate and sodium flow rate is kept more or less constant. The operation is carried out in a static mixer favouring satisfactory exchange between the liquid sodium and the gases. The role of the inert gas, which is preferentially nitrogen, is firstly to dilute the water vapour and place it in contact with the sodium, and secondly to evacuate the hydrogen formed by the reaction. The quantity of nitrogen required per gram of water is preferentially between 30 and 40 $dm^3/g$. This quantity is significantly lower than that mentioned in the patent FR 1214176, which recommends a ratio of the dispersion gas volume over the sodium volume between 20 and 200, while the quantity mentioned above, for practically complete calcium purification, results in a ratio of the order of 6. This makes it possible to avoid recycling the gas, which simplifies the installation considerably.

The temperature of the liquid sodium in the mixer must be greater than or equal to 150° C. to prevent any risk of fouling of the mixer. It is preferable to avoid excessively high temperatures, for example greater than 250° C., both for safety reasons and to prevent corrosion of the installation.

At the mixer outlet, the purified sodium is firstly separated from the gases via a degasser, followed by the lime by filtration.

DESCRIPTION OF FIGURES

The single FIGURE is a principle diagram of the method according to the invention.

EXAMPLE OF EMBODIMENT

The example relates to a pilot installation using the method according to the invention. The technical sodium is conveyed to the static mixer 1 using a pump 2. The water is sent, using a pump 3, to an evaporator 4 at a temperature regulated to 130° C. A control system according to the sodium flow rate measured by a flow meter is associated with the pump 3, so as to keep the ratio K constant. The dry nitrogen is sent via a flow meter 5 to the evaporator 4. The wet nitrogen is then routed to a static mixer 1 in a pipe designed and heat-insulated to prevention water condensation. In addition, a one-way check valve on said pipe prevents the passage of the sodium to the evaporator 4. The purified sodium containing the precipitated lime and nitrogen with the hydrogen produced by the reaction passes through a degasser 6, where it releases the nitrogen and hydrogen, and then through filters 7 to separate the lime.

The installation is started up with dry nitrogen, water only being introduced once the normal sodium flow rate has been reached. To shut down the installation, the water pump 3 is shut down first, followed by the sodium pump 2 and finally the nitrogen flow rate.

In normal operation, there is a sodium flow rate of 700 kg/h, a water flow rate of 122 g/h and a nitrogen flow rate of 4000 l/h. The temperature in the mixer is 150° C. The calcium content of the initial sodium is 410 ppm and that of the purified sodium 27 ppm.

What is claimed is:

1. A continuous sodium purification method for reducing the calcium content of sodium, comprising:

placing unpurified liquid sodium in contact with a stream of a gas, at a temperature of at least 150° C., wherein the stream of the gas comprises water vapor and the gas is inert with respect to unpurified liquid sodium;

adding water to the gas in a stoichiometric quantity sufficient to oxidize calcium so as to lower the content of calcium in the unpurified liquid sodium to a desired level and thereby produce purified sodium comprising the gas, hydrogen and lime;

regulating a flow rate of the water according to a flow rate of the liquid sodium so as to create and/or maintain a substantially constant ratio of the flow rate of the water to the flow rate of the liquid sodium; and separating the purified sodium from the gas, the hydrogen and the lime.

2. A method according to claim 1, wherein the inert gas comprises nitrogen or argon.

3. A method according to claim 1, wherein the purified sodium is filtered to separate the lime.

4. A method according to claim 1, wherein the gas comprises nitrogen, and wherein the nitrogen is present in an amount of 30 to 40 $dm^3$ per gram of water contained in the stream of the gas.

5. A method according to claim 1, further comprising placing the liquid sodium and the gas in contact in a static mixer.

* * * * *